US011821175B2

(12) United States Patent
Imura et al.

(10) Patent No.: US 11,821,175 B2
(45) Date of Patent: Nov. 21, 2023

(54) WORK MACHINE

(71) Applicants: Hitachi Construction Machinery Co., Ltd., Tokyo (JP); Hitachi Construction Machinery Tierra Co., Ltd., Koka (JP)

(72) Inventors: Shinya Imura, Toride (JP); Kenichiro Nakatani, Kusatsu (JP)

(73) Assignees: Hitachi Construction Machinery Co., Ltd., Tokyo (JP); Hitachi Construction Machinery Tierra Co., Ltd., Koka (JP)

( * ) Notice: Subject to any disclaimer, the term of this patent is extended or adjusted under 35 U.S.C. 154(b) by 559 days.

(21) Appl. No.: 15/734,421

(22) PCT Filed: Mar. 29, 2019

(86) PCT No.: PCT/JP2019/014327

§ 371 (c)(1),
(2) Date: Dec. 2, 2020

(87) PCT Pub. No.: WO2020/202393

PCT Pub. Date: Oct. 8, 2020

(65) Prior Publication Data

US 2021/0164198 A1 Jun. 3, 2021

(51) Int. Cl.
*E02F 9/26* (2006.01)
*E02F 3/96* (2006.01)
(Continued)

(52) U.S. Cl.
CPC ..... *E02F 9/265* (2013.01); *E02F 3/964* (2013.01); *E02F 9/2033* (2013.01);
(Continued)

(58) Field of Classification Search
CPC ..... E02F 9/265; E02F 3/964; E02F 9/2033; E02F 9/2041; E02F 9/24; E02F 9/2228;
(Continued)

(56) References Cited

U.S. PATENT DOCUMENTS 11,268,259 B2 * 3/2022 Harada ..... G05D 1/0274
2006/0041361 A1 2/2006 Matrosov
(Continued)

FOREIGN PATENT DOCUMENTS

JP 5247938 B1 7/2013
JP 5356141 B2 12/2013
(Continued)

OTHER PUBLICATIONS

International Preliminary Report on Patentability (PCT/IB/338 & PCT/IB/373) issued in PCT Application No. PCT/JP2019/014327 dated Oct. 14, 2021, including English translation of document C2 (Japanese-language Written Opinion (PCT/ISA/237) filed on Dec. 2, 2020) (six (6) pages).
(Continued)

*Primary Examiner* — Aniss Chad
*Assistant Examiner* — Christine Nguyen Huynh
(74) *Attorney, Agent, or Firm* — Crowell & Moring LLP

(57) ABSTRACT

To provide a work machine having a blade provided to a track structure, and a swing structure provided swingably on the upper side of the track structure, which work machine allows for computation of the horizontal coordinates of the blade. The work machine includes: a swing-structure-position acquiring device that acquires a horizontal coordinate and an orientation of the swing structure; a swing sensor that senses a swing of the swing structure; a travel sensor that senses travelling of the track structure; and a controller that computes an orientation of the track structure, and a horizontal coordinate of the blade. The controller computes the orientation of the track structure by using a locus of the horizontal coordinate of the swing structure acquired by the swing-structure-position acquiring device in a case where a swing of the swing structure is not sensed, and travelling of the track structure is sensed; and computes the horizontal
(Continued)

coordinate of the blade on a basis of the computed orientation of the track structure, and the horizontal coordinate and the orientation of the swing structure acquired by the swing-structure-position acquiring device.

11 Claims, 9 Drawing Sheets

(51) Int. Cl.
*E02F 9/20* (2006.01)
*E02F 9/24* (2006.01)
*E02F 9/22* (2006.01)

(52) U.S. Cl.
CPC ..... *E02F 9/2041* (2013.01); *E02F 9/24* (2013.01); *E02F 9/2228* (2013.01); *E02F 9/2267* (2013.01); *E02F 9/2285* (2013.01); *E02F 9/2292* (2013.01); *E02F 9/2296* (2013.01)

(58) Field of Classification Search
CPC ..... E02F 9/2267; E02F 9/2285; E02F 9/2292; E02F 9/2296; E02F 3/845; E02F 9/123; E02F 3/844; E02F 9/26
See application file for complete search history.

(56) References Cited

U.S. PATENT DOCUMENTS

2013/0081836 A1 4/2013 Hayashi et al.
2014/0140799 A1* 5/2014 Moriguchi ..... E02F 9/0875 414/695.5
2017/0016211 A1* 1/2017 Arimatsu ..... G01S 19/14
2019/0249391 A1 8/2019 Kikuchi et al.
2020/0071909 A1 3/2020 Harada et al.

FOREIGN PATENT DOCUMENTS

WO WO 2018/179577 A1 10/2018
WO WO 2018/179963 A1 10/2018

OTHER PUBLICATIONS

International Search Report (PCT/ISA/210) issued in PCT Application No. PCT/JP2019/014327 dated Jun. 25, 2019 with English translation (four (4) pages).
Japanese-language Written Opinion (PCT/ISA/237) issued in PCT Application No. PCT/JP2019/014327 dated Jun. 25, 2019 (three (3) pages).

* cited by examiner

WORK MACHINE

TECHNICAL FIELD

The present invention relates to a work machine having a blade provided to a track structure, and a swing structure provided swingably on the upper side of the track structure.

BACKGROUND ART

Patent Document 1 discloses a technology for a bulldozer including a travelable machine body, and a blade provided on the front side of the machine body such that the blade can be raised and lowered, which technology allows for acquisition of the position of the machine body, and the position of the blade. The bulldozer includes: first and second antennas that are attached to an upper section of the machine body, and receive signals from an artificial satellite; a third antenna that is attached to the upper end of a pole coupled to the blade, and receives signals from the artificial satellite; and a control module that measures the position of the machine body by using the signals received at the first and second antennas, and measures the position of the blade by using the signals received at the third antenna. Note that the antennas, and the control module mentioned before form a GNSS (Global Navigation Satellite System).

PRIOR ART DOCUMENT

Patent Document

Patent Document 1: Japanese Patent No. 5356141

SUMMARY OF THE INVENTION

Problem to be Solved by the Invention

A hydraulic excavator, which is one type of work machine, includes: a travelable track structure; a swing structure provided swingably on the upper side of the track structure; a work device that is coupled to the front side of the swing structure, and performs excavation work and the like; and a blade that is provided on the front side of the track structure such that the blade can be raised and lowered, and performs levelling work and the like.

There is supposed a case in which the technology described in Patent Document 1 is applied to the hydraulic excavator mentioned above for the purpose of computing and displaying the horizontal coordinates of the blade, and the like in order to assist an operator, for example. That is, in the supposed case, the pole is coupled with the blade, the antenna is attached to the upper end of the pole, and the horizontal coordinates of the blade are computed by using signals received at the antenna. However, in this case, there is a possibility that the work device interferes with the pole or the antenna.

Based on the reason mentioned above, there is supposed a case in which the two antennas are attached only to the swing structure, and the horizontal coordinates and the orientation of the swing structure are computed by using signals received at the antennas. However, in this case, the horizontal coordinates of the blade cannot be computed because the orientation of the track structure is unknown.

An object of the present invention is to provide a work machine having a blade provided to a track structure, and a swing structure provided swingably on the upper side of the track structure, which work machine allows for computation of the horizontal coordinates of the blade.

Means for Solving the Problem

In order to achieve the object, the present invention provides a work machine including: a travelable track structure; a swing structure provided swingably on an upper side of the track structure; a work device coupled to a front side of the swing structure; a blade provided on a front side of the track structure such that the blade can be raised and lowered; and a lift cylinder that raises and lowers the blade. The work machine includes: a swing-structure-position acquiring device that acquires a horizontal coordinate and an orientation of the swing structure; a swing sensor that senses a swing of the swing structure; a travel sensor that senses travelling of the track structure; and a controller that computes an orientation of the track structure, and a horizontal coordinate of the blade. The controller computes the orientation of the track structure by using a locus of the horizontal coordinate of the swing structure, the horizontal coordinate being acquired by the swing-structure-position acquiring device, in a case where a swing of the swing structure is not sensed, and travelling of the track structure is sensed; and computes the horizontal coordinate of the blade on a basis of the computed orientation of the track structure, and the horizontal coordinate and the orientation of the swing structure acquired by the swing-structure-position acquiring device.

Advantages of the Invention

According to the present invention, a work machine having a blade provided to a track structure, and a swing structure provided swingably on the upper side of the track structure allows for computation of the horizontal coordinates of the blade.

MODES FOR CARRYING OUT THE INVENTION

A first embodiment of the present invention is explained with reference to the drawings, by using a hydraulic excavator as an example application subject of the present invention.

Figure 1:
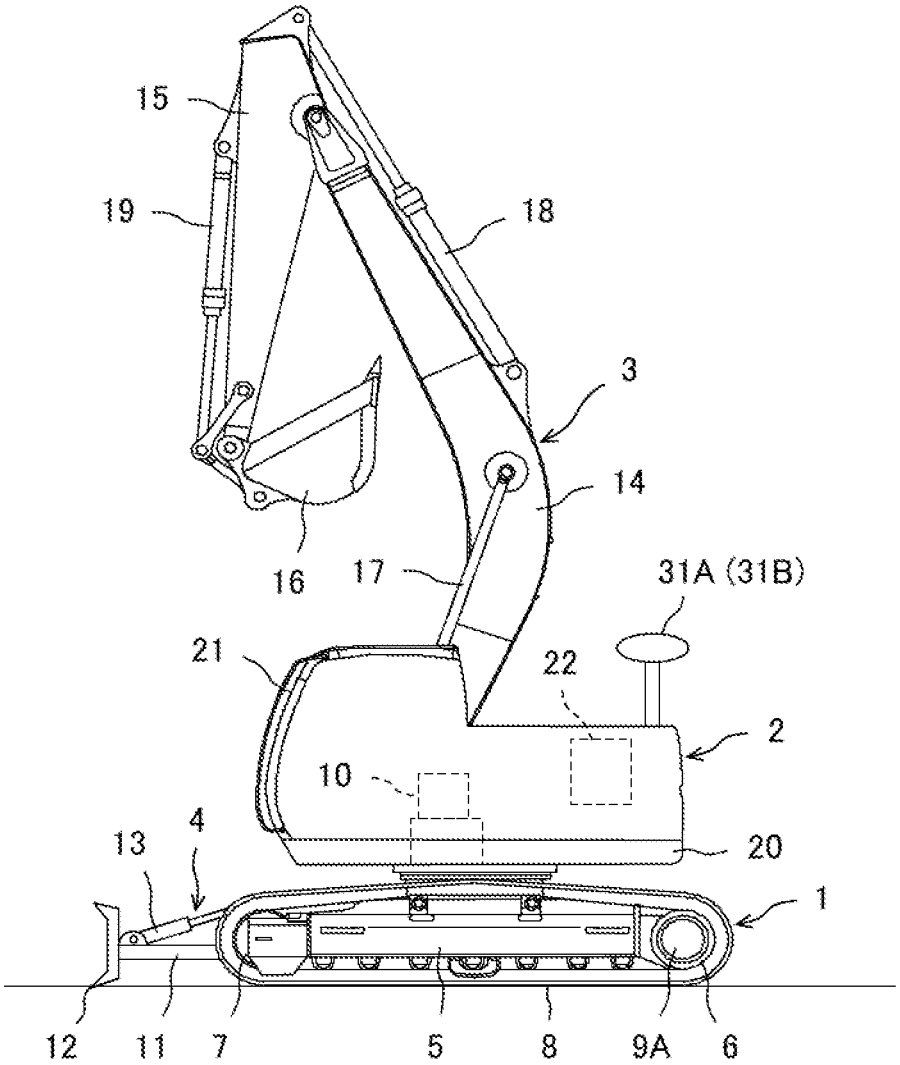
FIG. 1 is a side view representing the structure of a hydraulic excavator in a first embodiment of the present invention.

FIG. 1 is a side view representing the structure of a hydraulic excavator in the present embodiment.

The hydraulic excavator of the present embodiment includes: a travelable track structure 1; a swing structure 2 provided swingably on the upper side of the track structure 1; a work device 3 coupled to the front side of the swing structure 2; and an earth removing device 4 coupled to the front side of the track structure 1.

The track structure 1 includes a track frame 5. The track frame 5 includes: a center frame (not illustrated) that extends leftward and rightward relative to the track structure 1; a left side frame (see FIG. 1) that is coupled to the left side of the center frame, and extends forward and backward relative to the track structure 1; and a right side frame (not illustrated) that is coupled to the right side of the center frame, and extends forward and backward relative to the track structure 1.

A driving wheel 6 is arranged on the rear end of the left side frame, a follower wheel 7 is arranged on the front end of the left side frame, and a crawler (crawler) 8 is wound around and between the driving wheel 6 and the follower wheel 7. Then, the forward or backward rotation of a left travel motor 9A rotates the left driving wheel 6 forward or backward, and this in turn rotates the left crawler 8 forward or backward.

Similarly, a driving wheel is arranged on the rear end of the right side frame, a follower wheel is arranged on the front end of the right side frame, and a crawler is wound around and between the driving wheel and the follower wheel. Then, the forward or backward rotation of a right travel motor 9B (see FIG. 2 mentioned below) rotates the right driving wheel forward or backward, and this in turn rotates the right crawler forward or backward.

The swing structure 2 is provided swingably to the center frame via a slewing ring. Then, the rotation of a swing motor 10 in one direction or the opposite direction swings the swing structure 2 leftward or rightward.

The earth removing device 4 includes: a lift arm 11 coupled to the front side of the center frame such that the lift arm 11 can pivot upward and downward; and a blade (earth removing plate) 12 that is coupled to a tip section of the lift arm 11, and extends leftward and rightward relative to the track structure 1. That is, the blade 12 is provided on the front side of the track structure 1 such that the blade 12 can be raised and lowered. Then, the expansion or contraction of a lift cylinder 13 pivots the lift arm 11 downward or upward, and this in turn lowers or raises the blade 12.

The work device 3 includes: a boom 14 coupled to the front side of the swing structure 2 such that the boom 14 can pivot upward and downward; an arm 15 coupled to a tip section of the boom 14 such that the arm 15 can pivot upward and downward; and a bucket 16 coupled to a tip section of the arm 15 such that the bucket 16 can pivot upward and downward. Then, the expansion or contraction of a boom cylinder 17 pivots the boom 14 upward or downward, the expansion or contraction of an arm cylinder 18 pivots the arm 15 in the crowding direction (withdrawing direction) or the dumping direction (pushing direction), and the expansion or contraction of a bucket cylinder 19 pivots the bucket 16 in the bucket-crowding direction or the dumping direction.

The swing structure 2 includes a swing frame 20 forming the base structure, and a cab 21 provided at a front section of the swing frame 20. On the swing structure 2, an engine 22 as a prime mover, and equipment such as hydraulic pumps 23A and 23B or a control valve device 24 illustrated in FIG. 2 mentioned below are mounted.

An operator's seat (not illustrated) on which an operator is to be seated is provided in the cab 21. Travel operation devices 25A and 25B (see FIG. 2 mentioned below) through which instructions for the driving of the travel motor 9A and the driving of the travel motor 9B are given, respectively, are provided on the front side of the operator's seat. A work operation device 26A (see FIG. 2 mentioned below) through which instructions for the driving of the arm cylinder 18 and the driving of the swing motor 10 are selectively given is provided on the left side of the operator's seat. A work operation device 26B (see FIG. 2 mentioned below) through which instructions for the driving of the boom cylinder 17 and the driving of the bucket cylinder 19 are selectively given is provided on the right side of the operator's seat. A blade operation device 27 (see FIG. 2 mentioned below) through which instructions for the driving of the lift cylinder 13 are given is provided on the right side of the work operation device 26B. A monitor 30 (see FIG. 3 mentioned below) is provided on the front right side of the operator's seat.

Figure 2:
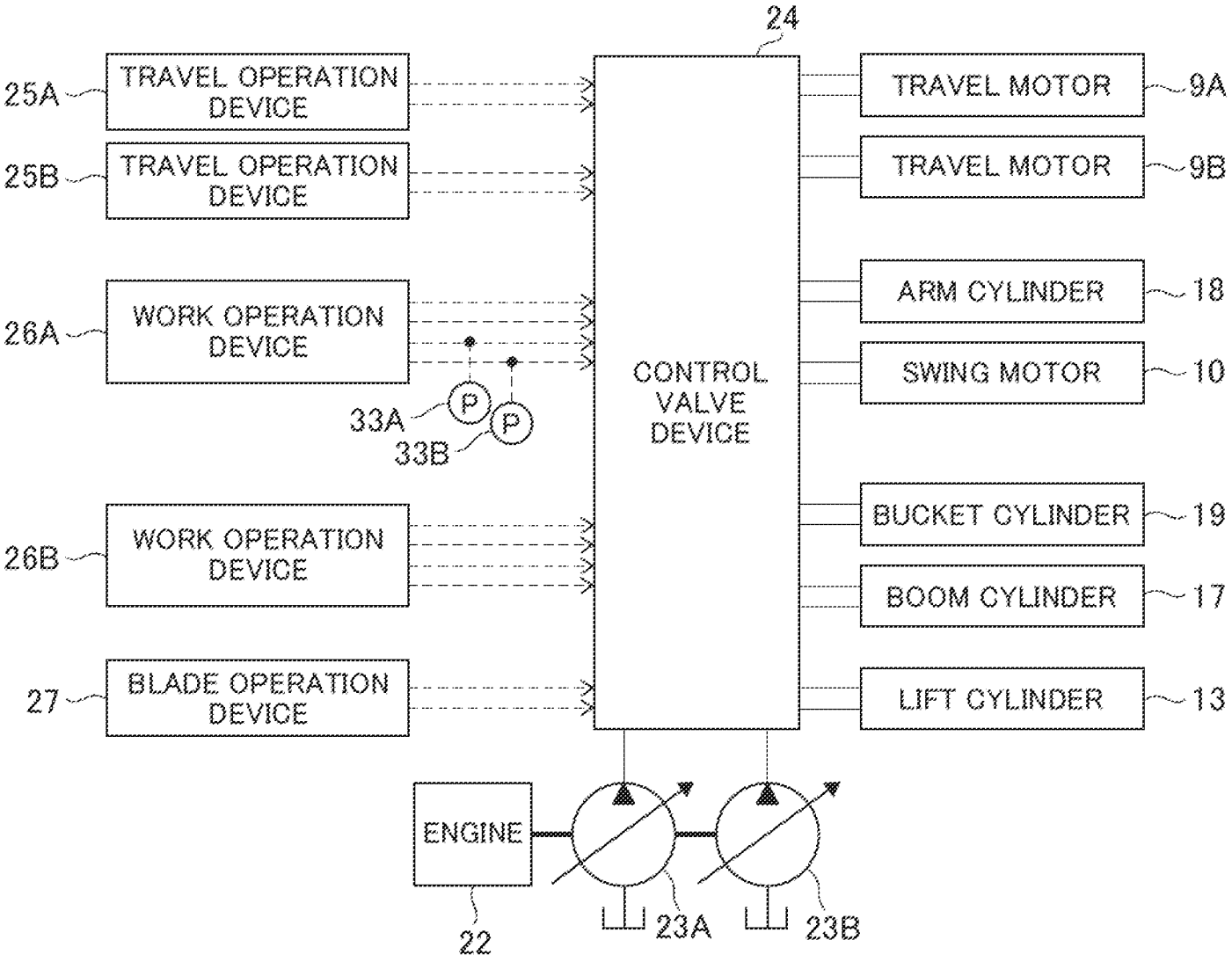
FIG. 2 is a schematic diagram representing the configuration of a hydraulic drive system in the first embodiment of the present invention.

The hydraulic excavator includes a hydraulic drive system that drives hydraulic actuators in accordance with operation of the operation devices mentioned above. The configuration of the hydraulic drive system is explained by using FIG. 2. FIG. 2 is a schematic diagram representing the configuration of the hydraulic drive system in the present embodiment.

The hydraulic drive system of the present embodiment includes: the engine 22; the variable displacement hydraulic pumps 23A and 23B driven by the engine 22; a plurality of hydraulic actuators (specifically, the travel motors 9A and 9B, the swing motor 10, the lift cylinder 13, the boom cylinder 17, the arm cylinder 18 and the bucket cylinder 19 mentioned above) driven by a hydraulic fluid from the hydraulic pumps 23A and 23B; the control valve device 24 that controls the flow of the hydraulic fluid from the hydraulic pumps 23A and 23B to the plurality of hydraulic actuators; and a plurality of operation devices (specifically, the travel operation devices 25A and 25B, the work operation devices 26A and 26B and the blade operation device 27 mentioned above).

Although not illustrated, the travel operation device 25A has: an operation lever that can be operated forward and backward; a left travel pilot valve that generates and outputs a forward travel pilot pressure (hydraulic pressure) in accordance with a forward operation amount of the operation lever; and a left travel pilot valve that generates and outputs a backward travel pilot pressure (hydraulic pressure) in accordance with a backward operation amount of the operation lever.

Similarly, although not illustrated, the travel operation device 25B has: an operation lever that can be operated forward and backward; a right travel pilot valve that generates and outputs a forward travel pilot pressure (hydraulic pressure) in accordance with a forward operation amount of the operation lever; and a right travel pilot valve that generates and outputs a backward travel pilot pressure (hydraulic pressure) in accordance with a backward operation amount of the operation lever.

Although not illustrated, the work operation device 26A has: an operation lever that can be operated leftward and rightward, and forward and backward; an arm pilot valve that generates and outputs an arm-dumping pilot pressure (hydraulic pressure) in accordance with a leftward operation amount of the operation lever; an arm pilot valve that generates and outputs an arm-crowding pilot pressure (hydraulic pressure) in accordance with a rightward operation amount of the operation lever; a swing pilot valve that generates and outputs a right-swing pilot pressure (hydraulic pressure) in accordance with a forward operation amount of the operation lever; and a swing pilot valve that generates and outputs a left-swing pilot pressure (hydraulic pressure) in accordance with a backward operation amount of the operation lever.

Although not illustrated, the work operation device 26B has: an operation lever that can be operated leftward and rightward, and forward and backward; a bucket pilot valve that generates and outputs a bucket-crowding pilot pressure (hydraulic pressure) in accordance with a leftward operation amount of the operation lever; a bucket pilot valve that generates and outputs a bucket-dumping pilot pressure (hydraulic pressure) in accordance with a rightward operation amount of the operation lever; a boom-pilot valve that generates and outputs a boom-lowering pilot pressure (hydraulic pressure) in accordance with a forward operation amount of the operation lever; and a boom-pilot valve that generates and outputs a boom-raising pilot pressure (hydraulic pressure) in accordance with a backward operation amount of the operation lever.

Although not illustrated, the blade operation device 27 has: an operation lever that can be operated forward and backward; a blade pilot valve that generates and outputs a blade-lowering pilot pressure (hydraulic pressure) in accordance with a forward operation amount of the operation lever; and a blade pilot valve that generates and outputs a blade-raising pilot pressure (hydraulic pressure) in accordance with a backward operation amount of the operation lever.

Although not illustrated, the control valve device 24 includes a hydraulic pilot type left travel control valve, right travel control valve, arm control valve, swing control valve, bucket control valve, boom control valve and blade control valve.

The left travel control valve is switched by the forward travel pilot pressure or the backward travel pilot pressure from the travel operation device 25A, and controls the flow (direction and flow rate) of the hydraulic fluid from the hydraulic pump to the left travel motor 9A. Thereby, the left travel motor 9A is rotated forward or backward.

Similarly, the right travel control valve is switched by the forward travel pilot pressure or the backward travel pilot pressure from the travel operation device 25B, and controls the flow (direction and flow rate) of the hydraulic fluid from the hydraulic pump to the right travel motor 9B. Thereby, the right travel motor 9B is rotated forward or backward.

The arm control valve is switched by the arm-crowding pilot pressure or the arm-dumping pilot pressure from the work operation device 26A, and controls the flow (direction and flow rate) of the hydraulic fluid from the hydraulic pump to the arm cylinder 18. Thereby, the arm cylinder 18 expands or contracts.

The swing control valve is switched by the left-swing pilot pressure or the right-swing pilot pressure from the work operation device 26A, and controls the flow (direction and flow rate) of the hydraulic fluid from the hydraulic pump to the swing motor 10. Thereby, the swing motor 10 rotates in one direction or in the opposite direction.

The bucket control valve is switched by the bucket-crowding pilot pressure or the bucket-dumping pilot pressure from the work operation device 26B, and controls the flow (direction and flow rate) of the hydraulic fluid from the hydraulic pump to the bucket cylinder 19. Thereby, the bucket cylinder 19 expands or contracts.

The boom control valve is switched by the boom-raising pilot pressure or the boom-lowering pilot pressure from the work operation device 26B, and controls the flow (direction and flow rate) of the hydraulic fluid from the hydraulic pump to the boom cylinder 17. Thereby, the boom cylinder 17 expands or contracts.

The blade control valve is switched by the blade-lowering pilot pressure or the blade-raising pilot pressure from the blade operation device 27, and controls the flow (direction and flow rate) of the hydraulic fluid from the hydraulic pump to the lift cylinder 13. Thereby, the lift cylinder 13 expands or contracts.

Figure 3:
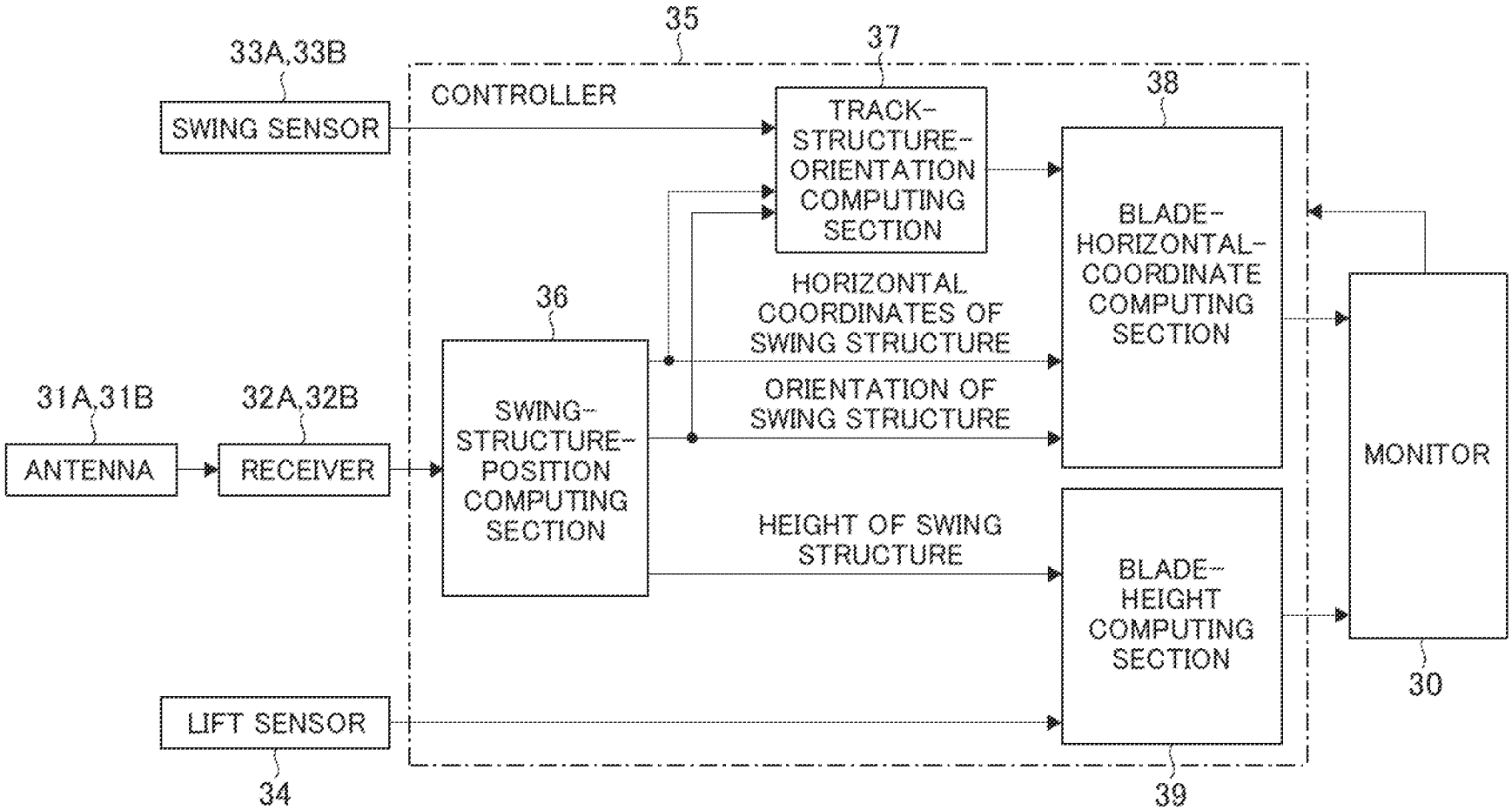
FIG. 3 is a block diagram representing the configuration of an assisting device in the first embodiment of the present invention.

The hydraulic excavator of the present embodiment includes an assisting device that computes and displays the position of the blade 12 (specifically, the horizontal coordinates and the height of the blade 12) in order to assist an operator. The configuration of the assisting device is explained by using FIG. 3. FIG. 3 is a block diagram representing the configuration of the assisting device in the present embodiment.

The assisting device of the present embodiment includes antennas 31A and 31B, receivers 32A and 32B, swing sensors 33A and 33B, a lift sensor 34, a controller 35 and the monitor 30.

The antennas 31A and 31B, and the receivers 32A and 32B form a satellite positioning system such as a GNSS. As illustrated in FIG. 1 mentioned above, the antennas 31A and 31B are provided on an upper section of the swing structure 2, and receive signals from an artificial satellite. The receivers 32A and 32B are connected to the antennas 31A and 31B, respectively. The receiver 32A measures the position of the antenna 31A on the Earth (specifically, the horizontal coordinates and the height of the antenna 31A) by using signals from the artificial satellite received at the antenna 31A, and outputs the measured position of the antenna 31A to the controller 35. Similarly, the receiver 32B measures the position of the antenna 31B on the Earth by using signals from the artificial satellite received at the antenna 31B, and outputs the measured position of the antenna 31B to the controller 35.

As illustrated in FIG. 2 mentioned above, the swing sensor 33A or 33B is a pressure sensor provided between the swing pilot valve of the work operation device 26A and the swing control valve of the control valve device 24. The swing sensor 33A or 33B senses a swing pilot pressure, and outputs the swing pilot pressure to the controller 35.

The lift sensor 34 is a displacement sensor that senses the stroke of the lift cylinder 13 as a state quantity related to the raising and lowering of the blade 12. The lift sensor 34 senses the stroke of the lift cylinder 13, and outputs the stroke to the controller 35.

Although not illustrated, for example, the monitor 30 has: a control section (e.g. a CPU) that executes calculation processes and control processes on the basis of a program; a storage section (e.g. a ROM and a RAM) that stores the program, and processing results; an operation switch; and a screen display section. The control section of the monitor 30 selects any one of a plurality of modes including a blade-position computation mode in accordance with operation of the operation switch, and controls the display of the screen display section in accordance with the selected mode.

Explaining specifically, in a case where the blade-position computation mode is selected, the monitor 30 sends a command for starting blade-position computation to the controller 35. Then, the monitor 30 receives the position of the blade 12 computed by the controller 35, and displays the position on the screen display section. Specifically, the position of the blade 12 may be displayed by numerical values or may be represented with shapes. On the other hand, in a case where another mode is selected, the monitor 30 sends a command for ending the blade-position computation to the controller 35. Then, the position of the blade is not displayed on the screen display section.

Although not illustrated, the controller 35 has: a control section (e.g. a CPU) that executes calculation processes and control processes on the basis of a program; and a storage section (e.g. a ROM and a RAM) that stores the program, and processing results. The controller 35 starts blade-position computation control in accordance with a command for starting the blade-position computation from the monitor 30, and ends the blade-position computation control in accordance with a command for ending the blade-position computation from the monitor 30. The controller 35 has a swing-structure-position computing section 36, a track-structure-orientation computing section 37, a blade-horizontal-coordinate computing section 38 and a blade-height computing section 39, as functional configurations related to the blade-position computation control.

The swing-structure-position computing section 36 of the controller 35 receives the horizontal coordinates of the antennas 31A and 31B from the receivers 32A and 32B, and computes, as the horizontal coordinates of the swing structure 2, the horizontal coordinates of the midpoint between the antennas 31A and 31B (specifically, the horizontal coordinates of the midpoint of a line segment linking the antenna 31A and the antenna 31B, but not the horizontal coordinates of a predetermined swing center point on the center line of the swing of the swing structure 2). In addition, the swing-structure-position computing section 36 computes the orientation of the swing structure 2 on the basis of the horizontal coordinates of the antennas 31A and 31B. Note that the orientation of the swing structure 2 means a direction that the front side of the swing frame 20 (specifically, the portion to which the work device 3 is coupled) faces.

In addition, the swing-structure-position computing section 36 of the controller 35 receives the heights of the antennas 31A and 31B from the receivers 32A and 32B, and computes, as the height of the swing structure 2, the average of the heights of the antennas 31A and 31B or selects the height of one of the antennas.

The track-structure-orientation computing section 37 of the controller 35 computes the orientation of the track structure 1 (details are mentioned below). Note that the orientation of the track structure 1 means a direction that the front side of the track frame 5 (specifically, the portion where the blade 12 is coupled via the lift arm 11) faces.

On the basis of the orientation of the track structure 1 computed by the track-structure-orientation computing section 37, and the horizontal coordinates and the orientation of the swing structure 2 computed by the swing-structure-position computing section 36, the blade-horizontal-coordinate computing section 38 of the controller 35 computes the horizontal coordinates of the blade 12 (specifically, the horizontal coordinates of the center point of the blade 12). Explaining specifically, the positional relationship between the midpoint between the antennas 31A and 31B and the swing center point of the swing structure 2 is stored in advance, and this positional relationship is used to compute the horizontal coordinates of the swing center point of the swing structure 2 from the horizontal coordinates and the orientation of the swing structure 2. In addition, the positional relationship between the swing center point of the swing structure 2 and the center point of the blade 12 is stored in advance, and this positional relationship is used to compute the horizontal coordinates of the blade 12 from the horizontal coordinates of the swing center point of the swing structure 2, and the orientation of the track structure 1.

On the basis of the stroke of the lift cylinder 13 sensed by the lift sensor 34, and the height of the swing structure 2 computed by the swing-structure-position computing section 36, the blade-height computing section 39 of the controller 35 computes the height of the blade 12 (specifically, the height of the lower end of the blade 12). Explaining specifically, the relationship between the stroke of the lift cylinder 13 and the relative height of the blade 12 relative to the swing center point of the swing structure 2 is stored in advance, and this relationship is used to compute the relative height of the blade 12 from the stroke of the lift cylinder 13. In addition, the positional relationship between the midpoint between the antennas 31A and 31B and the swing center point of the swing structure 2 is stored in advance, and this positional relationship is used to compute the height of the swing center point of the swing structure 2 from the height of the swing structure 2. Then, the absolute height of the blade 12 is computed on the basis of the height of the swing center point of the swing structure 2, and the relative height of the blade 12.

Figure 4:
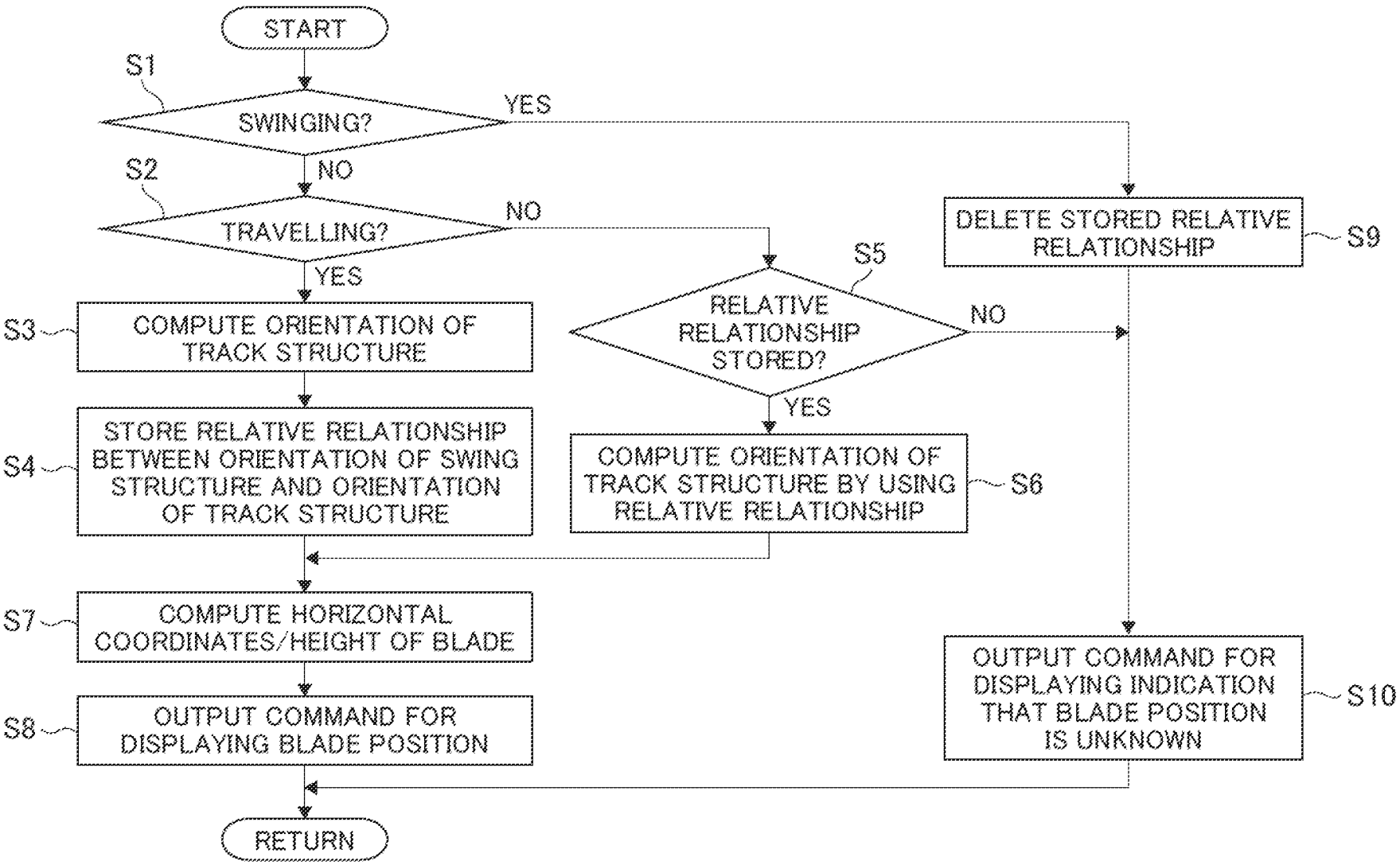
FIG. 4 is a flowchart representing a processing procedure of a controller in the first embodiment of the present invention.

Next, contents of processing performed in display control by the controller 35 in the present embodiment are explained by using FIG. 4. FIG. 4 is a flowchart representing a processing procedure of the controller in the present embodiment.

At Step S1, the track-structure-orientation computing section 37 of the controller 35 decides whether the swing structure 2 is swinging by deciding whether a larger one of the swing pilot pressures sensed by the swing sensors 33A and 33B is equal to or higher than a preset threshold, for example. In addition, for example, the time that has elapsed since both the swing pilot pressures sensed by the swing sensors 33A and 33B have become smaller than a threshold may be computed, and it may be decided that the swing structure 2 is still swinging if the elapsed time is shorter than a preset threshold.

In a case where it is decided at Step S1 that the swing structure 2 is not swinging (i.e. a swing of the swing structure 2 is not sensed), the result of the decision at Step S1 is NO, and the process proceeds to Step S2. At Step S2, the track-structure-orientation computing section 37 of the controller 35 computes the horizontal coordinates of the swing center point of the swing structure 2 on the basis of the horizontal coordinates and the orientation of the swing structure 2 computed by the swing-structure-position computing section 36, for example, and decides whether the track structure 1 is travelling by deciding whether the horizontal coordinates of the swing center point of the swing structure 2 are changing.

In a case where it is decided at Step S2 that the track structure 1 is travelling (i.e. in a case where travelling of the track structure 1 is sensed), the result of the decision at Step S2 is YES, and the process proceeds to Step S3. At Step S3, the track-structure-orientation computing section 37 of the controller 35 computes the current advancing direction of the track structure 1 by using the locus (history) of the horizontal coordinates of the swing structure 2 computed by the swing-structure-position computing section 36, and treats the current advancing direction as the orientation of the track structure 1.

After Step S3, the process proceed to Step S4. At Step S4, the track-structure-orientation computing section 37 of the controller 35 stores (updates) the relative relationship (relative angle) between the computed orientation of the track structure 1 and the orientation of the swing structure 2 computed by the swing-structure-position computing section 36.

In a case where it is decided at Step S2 that the track structure 1 is not travelling (i.e. in a case where travelling of the track structure 1 is not sensed), the result of the decision at Step S2 is NO, and the process proceeds to Step S5. At Step S5, the track-structure-orientation computing section 37 of the controller 35 decides whether the relative relationship between the orientation of the track structure 1 and the orientation of the swing structure 2 is stored.

In a case where the relative relationship between the orientation of the track structure 1 and the orientation of the swing structure 2 is stored at Step S5, the result of the decision at Step S5 is YES, and the process proceeds to Step S6. At Step S6, by using the stored relative relationship between the orientation of the track structure 1 and the orientation of the swing structure 2, the track-structure-orientation computing section 37 of the controller 35 computes the current orientation of the track structure 1 from the current orientation of the swing structure 2 computed by the swing-structure-position computing section 36. Thereby, even if the track structure 1 makes a spin turn, the orientation of the track structure 1 can be computed.

After Step S4 or S6, the process proceed to Step S7. At Step S7, the blade-horizontal-coordinate computing section 38 of the controller 35 computes the horizontal coordinates of the blade 12 on the basis of the orientation of the track structure 1 computed at Step S3 or S6 mentioned above, and the horizontal coordinates and the orientation of the swing structure 2 computed by the swing-structure-position computing section 36. On the basis of the stroke of the lift cylinder 13 sensed by the lift sensor 34, and the height of the swing structure 2 computed by the swing-structure-position computing section 36, the blade-height computing section 39 of the controller 35 computes the height of the blade 12.

After Step S7, the process proceed to Step S8. At Step S8, the controller 35 sends a command for displaying a blade position to the monitor 30, together with the computed horizontal coordinates and the computed height of the blade 12. Thereby, the monitor 30 displays the position of the blade 12.

In a case where it is decided at Step S1 that the swing structure 2 is swinging (i.e. a swing of the swing structure 2 is sensed), the result of the decision at Step S1 is YES, and the process proceeds to Step S9. At Step S9, the track-structure-orientation computing section 37 of the controller 35 deletes the stored relative relationship between the orientation of the track structure 1 and the orientation of the swing structure 2.

After Step S9, the process proceeds to Step S10. In addition, in a case where the relative relationship between the orientation of the track structure 1 and the orientation of the swing structure 2 is not stored at Step S5, the result of the decision at Step S5 is NO, and the process proceeds to Step S10. At Step S10, the track-structure-orientation computing section 37 of the controller 35 sends, to the monitor 30, a command for displaying an indication that the blade position is unknown. Thereby, the monitor 30 displays an indication that the blade position is unknown. Specifically, numerical value display fields may be left blank, or shapes may be deleted.

As mentioned above, in the present embodiment, it is possible to compute the horizontal coordinates and the height of the blade 12 in the hydraulic excavator having the blade 12 provided to the track structure 1 and the swing structure 2 provided swingably on the upper side of the track structure 1. Then, the horizontal coordinates and the height of the blade 12 can be displayed to assist an operator.

Note that, in the explanation above, the antennas 31A and 31B, the receivers 32A and 32B, and the swing-structure-position computing section 36 of the controller 35 form the swing-structure-position acquiring device described in CLAIMS that acquires the horizontal coordinates and the orientation of the swing structure, and form the swing-structure-position acquiring device that further acquires the height of the swing structure. In addition, the function of the controller 35 to decide whether the swing structure 2 is swinging on the basis of swing pilot pressures forms the swing sensor that senses a swing of the swing structure. In addition, the function of the controller 35 to decide whether the track structure 1 is travelling on the basis of the horizontal coordinates of the swing center point of the swing structure 2 forms the travel sensor that senses travelling of the track structure.

In addition, the monitor 30 forms the mode selecting device that selects either the blade-position computation mode in which the position of the blade is computed or the other mode in which the position of the blade is not computed, and forms the display device that displays the horizontal coordinates and the height of the blade computed by the controller.

Figure 5:
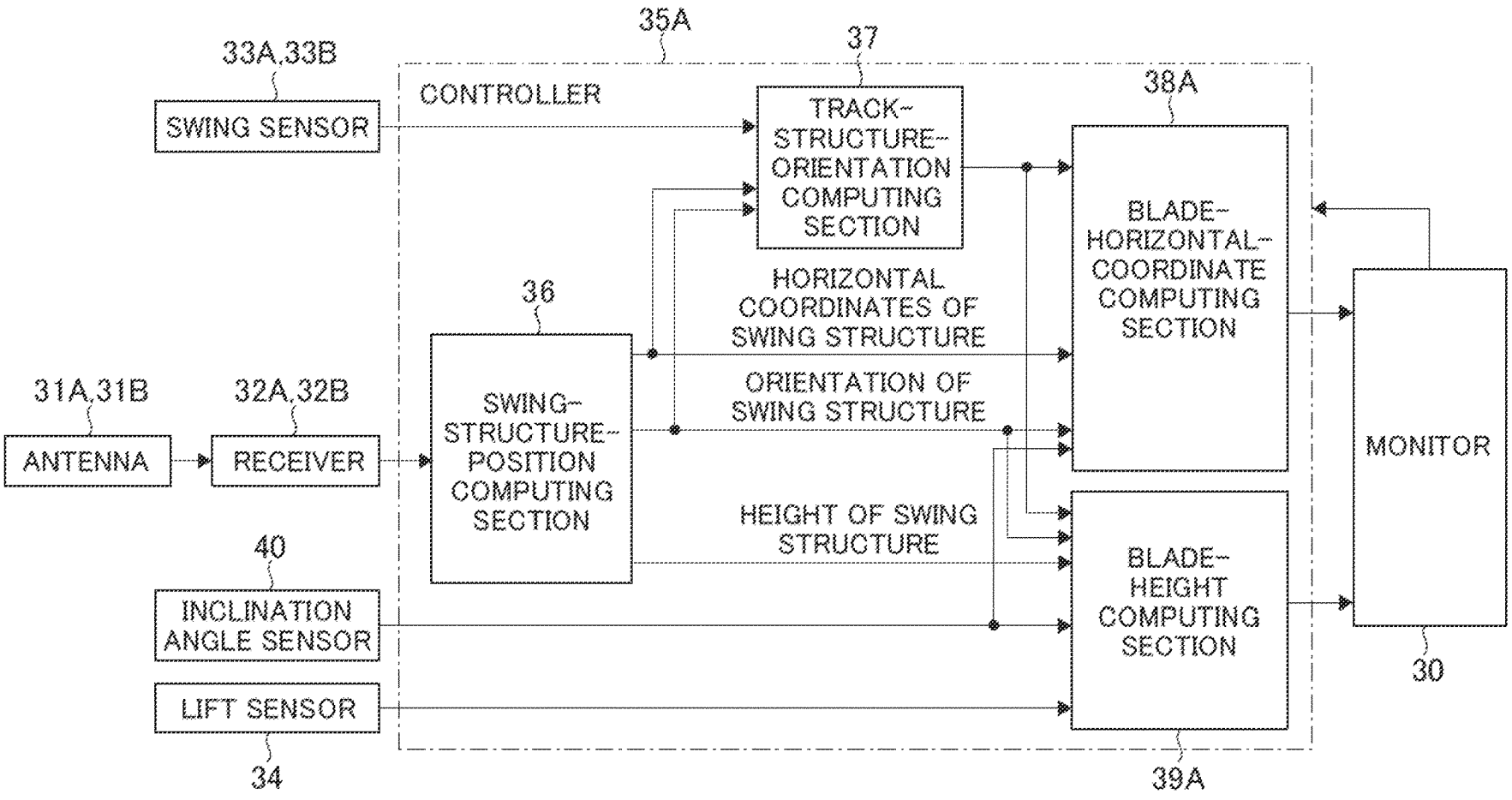
FIG. 5 is a block diagram representing the configuration of the assisting device in a second embodiment of the present invention.

A second embodiment of the present invention is explained by using FIG. 5. Note that portions in the present embodiment that are equivalent to their counterparts in the first embodiment are given the same reference characters, and explanation thereof is omitted as appropriate.

FIG. 5 is a block diagram representing the configuration of the assisting device in the present embodiment.

The assisting device of the present embodiment further includes an inclination angle sensor 40. The inclination angle sensor 40 senses forward-backward and leftward-rightward inclination angles of the track structure 1, and outputs the inclination angles to a controller 35A.

On the basis of the orientation of the track structure 1 computed by the track-structure-orientation computing section 37, the horizontal coordinates and the orientation of the swing structure 2 computed by the swing-structure-position computing section 36, and the inclination angles of the track structure 1 sensed by the inclination angle sensor 40, a blade-horizontal-coordinate computing section 38A of the controller 35A of the present embodiment computes the horizontal coordinates of the blade 12. Explaining specifically, inclination angles of the swing structure 2 are computed on the basis of the orientation of the swing structure 2 and the orientation and inclination angles of the track structure 1. Then, the horizontal coordinates of the swing center point of the swing structure 2 are computed on the basis of the horizontal coordinates, the orientation and the inclination angles of the swing structure 2. Then, the horizontal coordinates of the blade 12 are computed on the basis of the horizontal coordinates of the swing center point of the swing structure 2 and the orientation and the inclination angles of the track structure 1.

On the basis of the stroke of the lift cylinder 13 sensed by the lift sensor 34, the height of the swing structure 2 computed by the swing-structure-position computing section 36, and the inclination angles of the track structure 1 sensed by the inclination angle sensor 40, a blade-height computing section 39A of the controller 35A computes the height of the blade 12. Explaining specifically, a relative height of the blade 12 is computed from the stroke of the lift cylinder 13. In addition, the inclination angles of the swing structure 2 are computed on the basis of the orientation of the swing structure 2 and the orientation and the inclination angles of the track structure 1. Then, the height of the swing center point of the swing structure 2 is computed on the basis of the height, the orientation and the inclination angles of the swing structure 2. Then, the absolute height of the blade 12 is computed on the basis of the height of the swing center point of the swing structure 2 and the relative height of the blade 12.

In the thus-configured present embodiment also, the horizontal coordinates and the height of the blade 12 can be computed in a similar manner to the first embodiment. Then, the horizontal coordinates and the height of the blade 12 can be displayed to assist an operator. In addition, the precision of the horizontal coordinates and the height of the blade 12 can be enhanced over the first embodiment.

Figure 6:
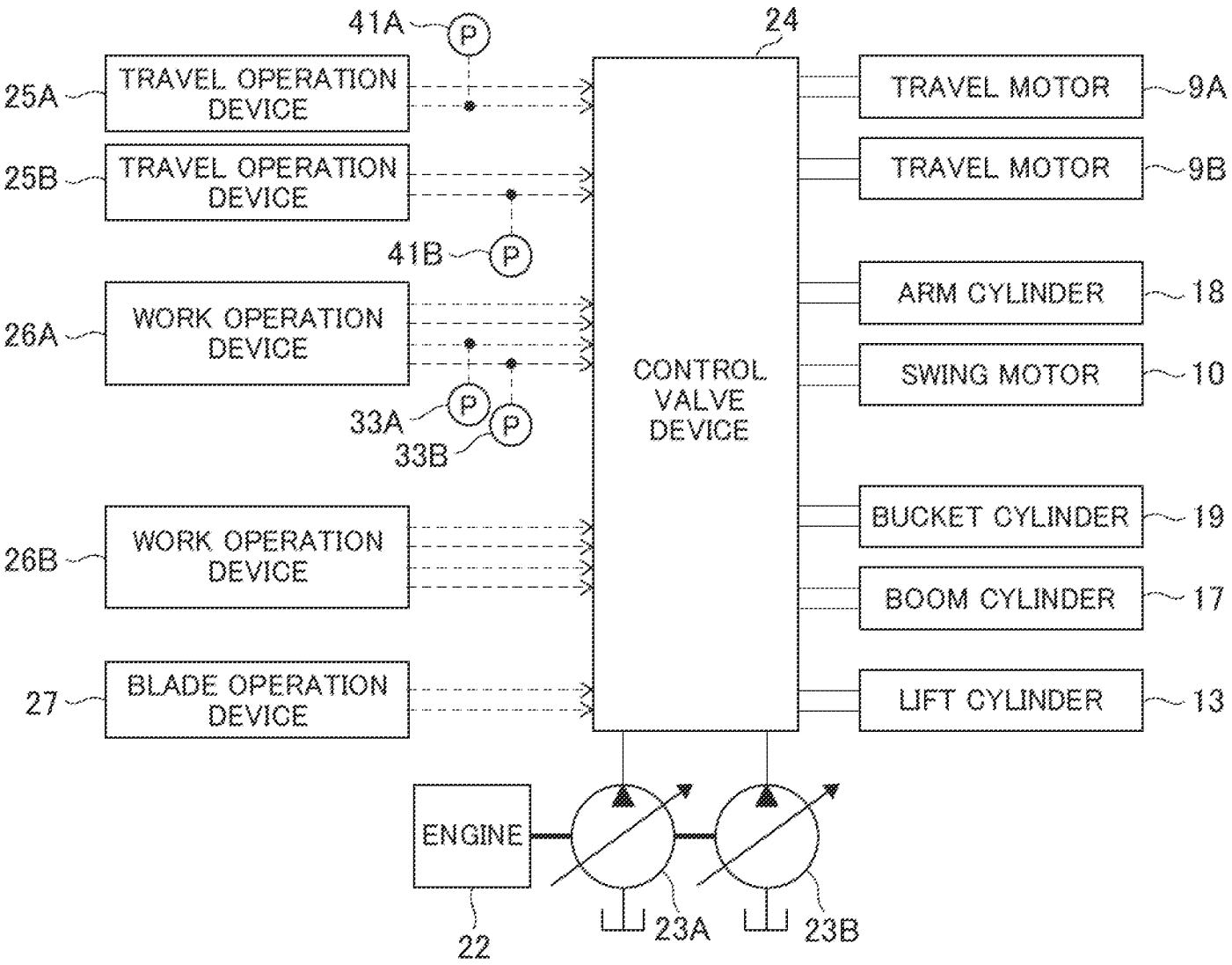
FIG. 6 is a schematic diagram representing the configuration of the hydraulic drive system in a third embodiment of the present invention.
Figure 7:
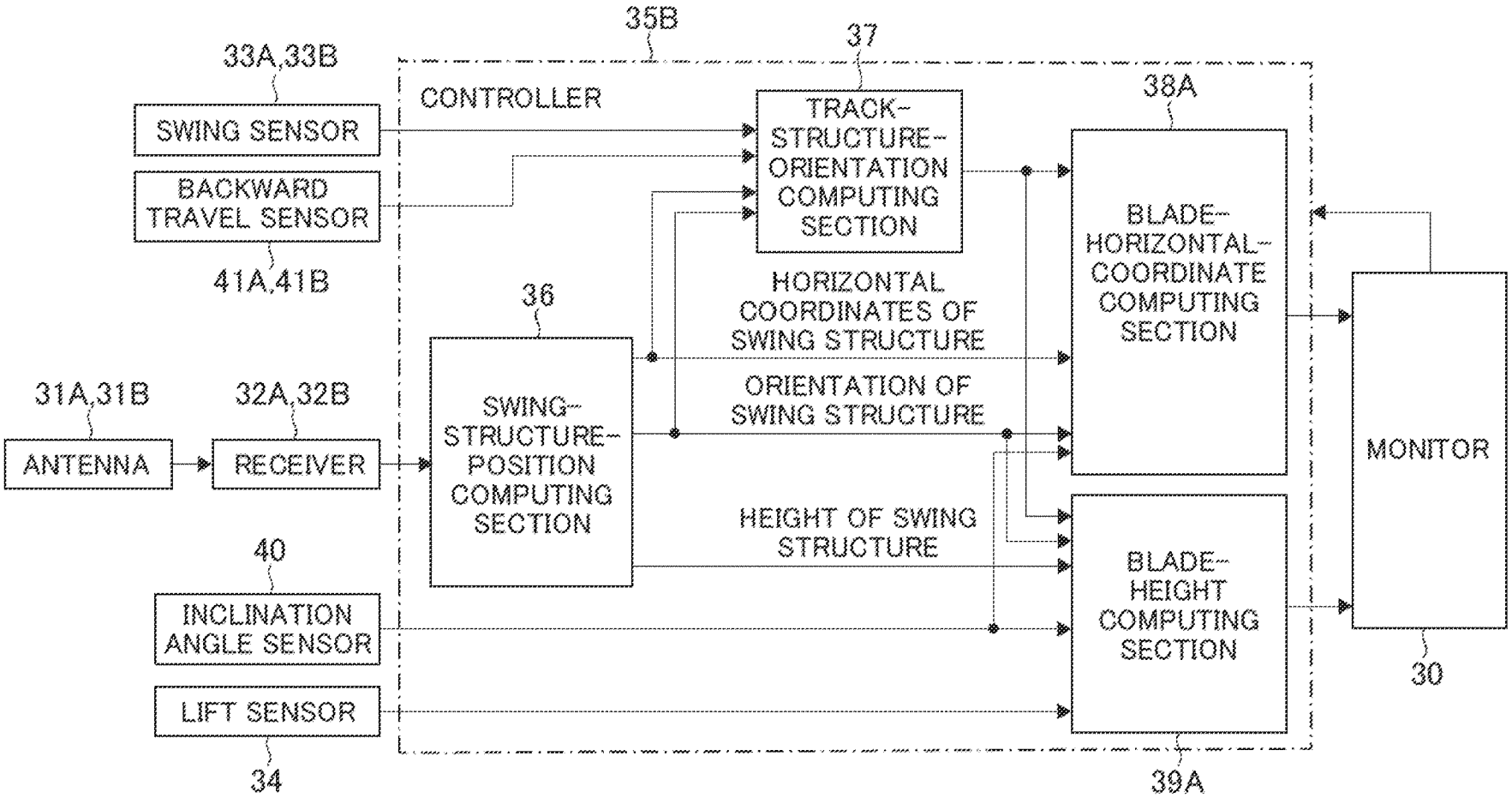
FIG. 7 is a block diagram representing the configuration of the assisting device in the third embodiment of the present invention.

A third embodiment of the present invention is explained by using FIG. 6 and FIG. 7. Note that portions in the present embodiment that are equivalent to their counterparts in the first and second embodiments are given the same reference characters, and explanation thereof is omitted as appropriate.

It is supposed in the first and second embodiments that levelling work and the like are performed with the blade 12 by causing the track structure 1 to travel forward. In contrast to this, in the present embodiment, it is supposed that levelling work and the like are performed with the blade 12 by causing the track structure 1 to travel forward or backward. Accordingly, the assisting device of the present embodiment includes backward travel sensors 41A and 41B that sense backward travel pilot pressures of the travel operation devices 25A and 25B.

In a case where it is decided at Step S2 in FIG. 4 mentioned above that the track structure 1 is travelling, the track-structure-orientation computing section 37 of a controller 35B of the present embodiment decides whether both the backward travel pilot pressures sensed by the backward travel sensors 41A and 41B are equal to or higher than a preset threshold. Then, if both the backward travel pilot pressures are equal to or higher than the threshold, it is decided that the track structure 1 is travelling backward (i.e. backward travelling is sensed), and if both the backward travel pilot pressures are lower than the threshold, it is decided that the track structure 1 is travelling forward (i.e. forward travelling is sensed).

At Step S3 in FIG. 4 mentioned above, the track-structure-orientation computing section 37 of the controller 35B computes the orientation of the track structure 1 by using the locus of the horizontal coordinates of the swing structure 2 computed by the swing-structure-position computing section 36 and the result of the sensing whether the track structure 1 is travelling forward or backward. Explaining specifically, in a case where forward travelling of the track structure 1 is sensed, the current advancing direction of the track structure 1 is computed by using the locus of the horizontal coordinates of the swing structure 2 computed by the swing-structure-position computing section 36, and the advancing direction is treated as the orientation of the track structure 1. On the other hand, in a case where backward travelling of the track structure 1 is sensed, the current advancing direction of the track structure 1 is computed by using the locus of the horizontal coordinates of the swing structure 2 computed by the swing-structure-position computing section 36, and the direction opposite to the advancing direction is treated as the orientation of the track structure 1.

In the thus-configured present embodiment also, the horizontal coordinates and the height of the blade 12 can be computed in a similar manner to the first and second embodiments. Then, the horizontal coordinates and the height of the blade 12 can be displayed to assist an operator. In addition, unlike the first and second embodiments, it is possible to cope with levelling work and the like performed with the blade 12 by causing the track structure 1 to travel backward.

Note that the function of the controller 35B described above to decide whether the track structure 1 is travelling on the basis of the horizontal coordinates of the swing center point of the swing structure 2, and to decide whether the travelling of the track structure 1 is backward travelling on the basis of backward travel pilot pressures forms the travel sensor that senses forward travelling and backward travelling of the track structure.

Figure 8:
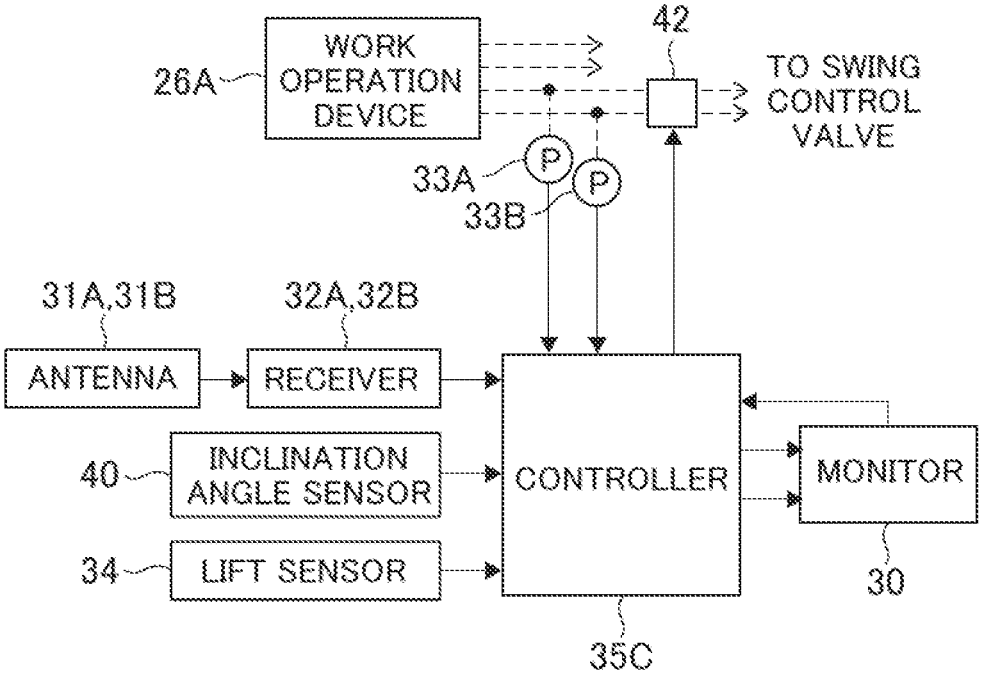
FIG. 8 is a figure representing the configuration of the assisting device in a fourth embodiment of the present invention.

A fourth embodiment of the present invention is explained by using FIG. 8. Note that portions in the present embodiment that are equivalent to their counterparts in the first and second embodiments are given the same reference characters, and explanation thereof is omitted as appropriate.

In the present embodiment, a swing limiting valve 42 (swing limiting device) is provided between the swing pilot valve of the work operation device 26A and the swing control valve of the control valve device 24. The swing limiting valve 42 is a solenoid selector valve that can be switched between a communication position and an interruption position.

A controller 35C of the present embodiment has the swing-structure-position computing section 36, the track-structure-orientation computing section 37, the blade-horizontal-coordinate computing section 38A and the blade-height computing section 39A, in a similar manner to the controller 35A of the second embodiment. In addition, the controller 35C controls the swing limiting valve 42 such that the swing limiting valve 42 is switched from the communication position to the interruption position in accordance with a command for starting the blade-position computation from the monitor 30. In addition, the controller 35C controls the swing limiting valve 42 such that the swing limiting valve 42 is switched from the interruption position to the communication position, in accordance with a command for ending the blade-position computation from the monitor 30.

In a case where the swing limiting valve 42 is at the communication position, communication is established through a hydraulic line between the swing pilot valve and the swing control valve. Thereby, it becomes possible to output the swing pilot pressure from the swing pilot valve to the swing control valve. That is, the swing of the swing structure 2 is not limited. On the other hand, in a case where the swing limiting valve 42 is at the interruption position, communication through the hydraulic line between the swing pilot valve and the swing control valve is interrupted. Thereby, it becomes impossible to output the swing pilot pressure from the swing pilot valve to the swing control valve. That is, the swing of the swing structure 2 is limited.

In the thus-configured present embodiment also, the horizontal coordinates and the height of the blade 12 can be computed in a similar manner to the first and second embodiments. Then, the horizontal coordinates and the height of the blade 12 can be displayed to assist an operator. In addition, computation and display of the blade position can be enhanced because the swing of the swing structure 2 is limited by the swing limiting valve 42 when the blade-position computation mode is selected by the monitor 30, unlike the first and second embodiments.

Note that although the swing limiting device is the swing limiting valve 42 in the example explained in the fourth embodiment, this is not the sole example, and modifications are possible within a scope not deviating from the gist of the present invention. The swing limiting device may be a swing brake that limits the swing of the swing structure 2 by frictional force, for example.

In addition, although not explained in the fourth embodiment particularly, the track-structure-orientation computing section 37 of the controller 35C may decide whether travelling of the track structure 1 is backward travelling on the basis of backward travel pilot pressures, in a similar manner to the third embodiment. Then, the orientation of the track structure 1 may be computed by using the locus of the horizontal coordinates of the swing structure 2 computed by the swing-structure-position computing section 36 and the result of the sensing whether the track structure 1 is travelling forward or backward.

In addition, although, in the example explained in the first to fourth embodiments, the track-structure-orientation computing section 37 of the controllers stores the relative relationship between the computed orientation of the track structure 1 and the orientation of the swing structure 2 computed by the swing-structure-position computing section 36 in a case where a swing of the swing structure 2 is not sensed and travelling of the track structure 1 is sensed, and computes the current orientation of the track structure 1 from the current orientation of the swing structure 2 computed by the swing-structure-position computing section 36 by using the stored relative relationship between the orientation of the track structure 1 and the orientation of the swing structure 2 in a case where a swing of the swing structure 2 is not sensed and travelling of the track structure 1 is not sensed, this is not the sole example, and modifications are possible within a scope not deviating from the gist of the present invention. For example, in a case where a swing of the swing structure 2 is not sensed and travelling of the track structure 1 is sensed, the track-structure-orientation computing section 37 of the controllers may not store the relative relationship between the orientation of the track structure 1 and the orientation of the swing structure 2 (i.e. Step S4 in FIG. 4 mentioned above may not be executed). Then, in a case where a swing of the swing structure 2 is not sensed and travelling of the track structure 1 is not sensed, the track-structure-orientation computing section 37 of the controllers may output a command for displaying an indication that the blade position is unknown (i.e. the process may proceed to Step S10 in a case where the result of the decision at Step S2 in FIG. 4 mentioned above becomes NO).

In addition, although, in the examples explained in the first to fourth embodiments, the assisting device includes the lift sensor 34, the controllers compute the height of the swing structure 2, and the height of the blade 12, and the monitor 30 displays the height of the blade 12, this is not the sole example, and modifications are possible within a scope not deviating from the gist of the present invention. For example, the assisting device may not include the lift sensor 34, the controllers may not compute the height of the swing structure 2, and the height of the blade 12, and the monitor 30 may not display the height of the blade 12.

Figure 9:
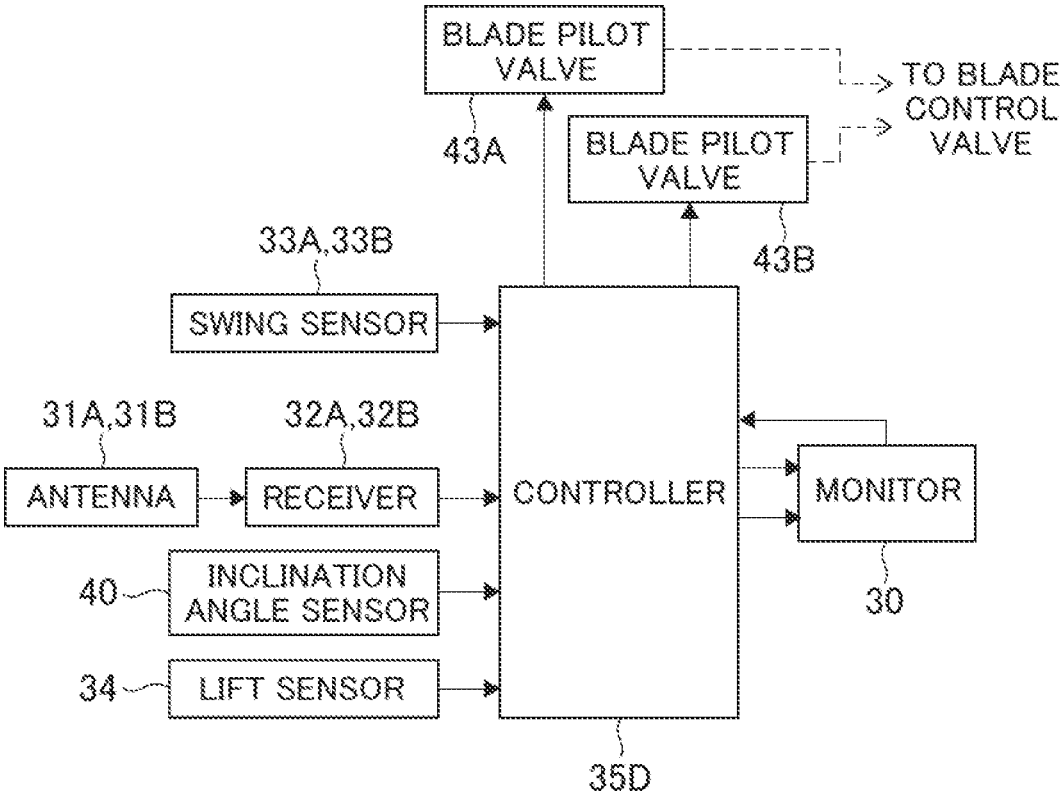
FIG. 9 is a block diagram representing the configuration of the assisting device in a fifth embodiment of the present invention.

A fifth embodiment of the present invention is explained by using FIG. 9. Note that portions in the present embodiment that are equivalent to their counterparts in the first and second embodiments are given the same reference characters, and explanation thereof is omitted as appropriate.

FIG. 9 is a block diagram representing the configuration of the assisting device in the present embodiment.

The assisting device of the present embodiment performs blade automatic control of computing the horizontal coordinates and the height of the blade 12, and controlling the operation of the lift cylinder 13 on the basis of the horizontal coordinates and the height of the blade 12. Accordingly, the hydraulic excavator includes solenoid blade pilot valves 43A and 43B.

A controller 35D of the present embodiment has the swing-structure-position computing section 36, the track-structure-orientation computing section 37, the blade-horizontal-coordinate computing section 38A and the blade-height computing section 39A, in a similar manner to the controller 35A of the second embodiment. In addition, on the basis of the horizontal coordinates of the blade 12 computed by the blade-horizontal-coordinate computing section 38A and the height of the blade 12 computed by the blade-height computing section 39A, the controller 35D executes the blade automatic control of controlling the blade pilot valves 43A and 43B. The controller 35D starts the blade automatic control in accordance with a command for starting the blade-position computation from the monitor 30 according to operation by an operator, and ends the blade automatic control in accordance with a command for ending the blade-position computation from the monitor 30.

The blade pilot valve 43A generates and outputs a blade-lowering pilot pressure in accordance with a signal from the controller 35D, and the blade pilot valve 43B generates and outputs a blade-raising pilot pressure in accordance with a signal from the controller 35D. The blade control valve is switched by the blade-lowering pilot pressure or the blade-raising pilot pressure mentioned before, and controls the flow of the hydraulic fluid from the hydraulic pump to the lift cylinder 13.

The controller 35D stores in advance a target surface of a terrain profile set on the monitor 30. Alternatively, the controller 35D receives an input of a target surface of a terrain profile set on an external computer via a communication network or a storage medium, and stores the target surface in advance. Note that the monitor 30 or the external computer forms the target-surface setting device on which a target surface is set.

Figure 10:
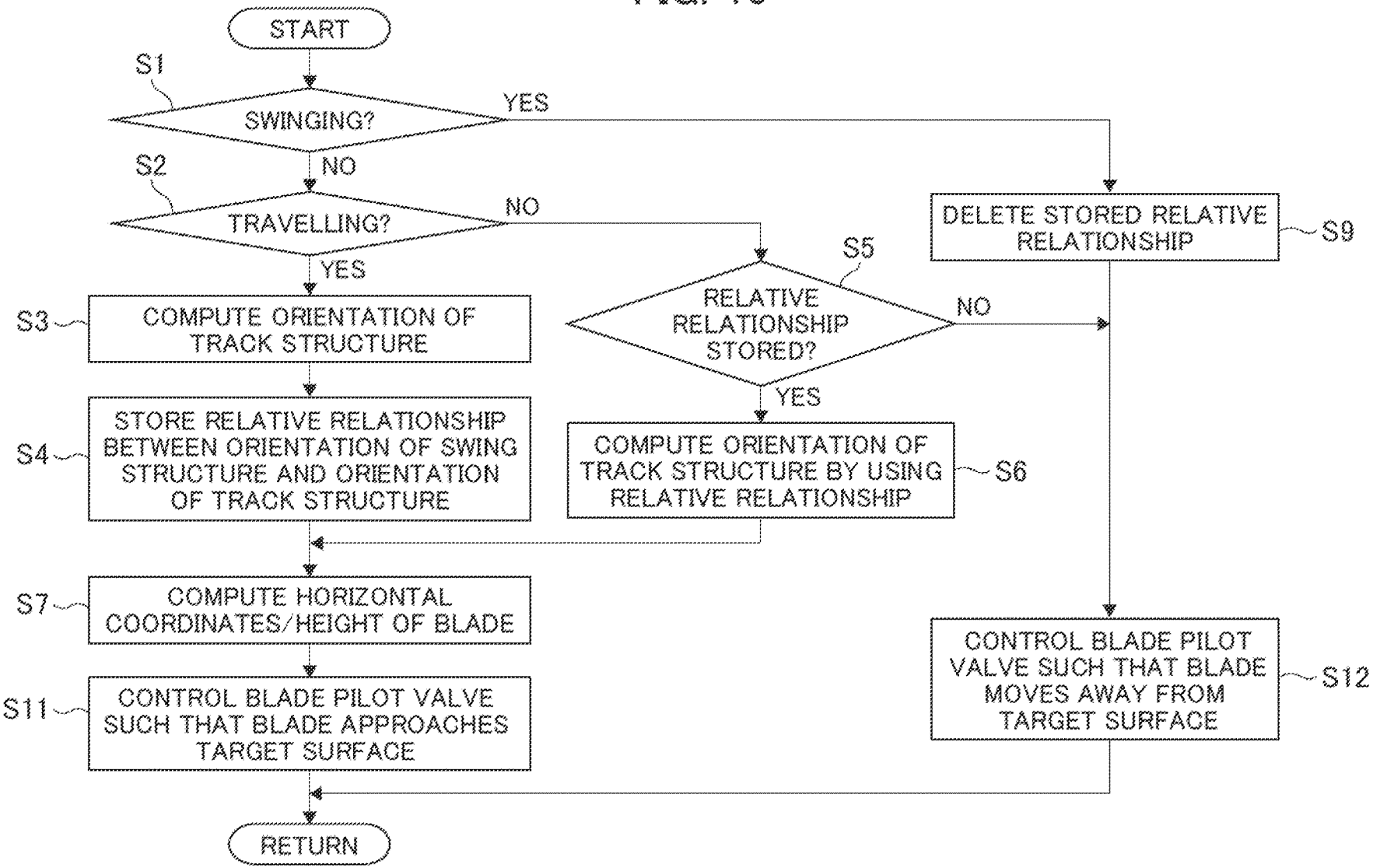
FIG. 10 is a flowchart representing a processing procedure of a controller in the fifth embodiment of the present invention.

Next, contents of processing performed in the blade automatic control of the controller in the present embodiment are explained by using FIG. 10. FIG. 10 is a flowchart representing a processing procedure of the controller in the present embodiment.

Steps S1 to S7 and S9 are the same as the embodiments described above, and so explanation thereof is omitted.

In a case where the horizontal coordinates and the height of the blade 12 are computed (i.e. after Step S7), the process proceeds to Step S11. At Step S11, the controller 35D controls the blade pilot valves 43A and 43B such that the blade 12 (specifically, the lower end of the blade 12) approaches the prestored target surface.

In a case where at least either the horizontal coordinates or height of the blade 12 are/is not computed (i.e. after Step S9, or in a case where the result of the decision at Step S5 is NO), the process proceed to Step S12. At Step S12, the controller 35D controls the blade pilot valves 43A and 43B such that the blade 12 moves upward away from the target surface.

In the thus-configured present embodiment also, it is possible to compute the horizontal coordinates and the height of the blade 12 in the hydraulic excavator having the blade 12 provided to the track structure 1 and the swing structure 2 provided swingably on the upper side of the track structure 1. Then, the operation of the lift cylinder 13 can be controlled on the basis of the horizontal coordinates and the height of the blade 12 to assist an operator.

Note that although not explained particularly, the monitor 30 may display the position of the blade 12 computed by the controller 35D in the fifth embodiment, in a similar manner to the first to fourth embodiments. In addition, although not explained particularly, the track-structure-orientation computing section 37 of the controller 35D may decide whether travelling of the track structure 1 is backward travelling on the basis of the backward travel pilot pressure in the fifth embodiment, in a similar manner to the third embodiment. Then, the orientation of the track structure 1 may be computed by using the locus of the horizontal coordinates of the swing structure 2 computed by the swing-structure-position computing section 36 and the result of the sensing whether the track structure 1 is travelling forward or backward.

In addition, although, in the example explained in the fifth embodiment, as illustrated in FIG. 10 mentioned above, the track-structure-orientation computing section 37 of the controller 35D stores the relative relationship between the computed orientation of the track structure 1 and the orientation of the swing structure 2 computed by the swing-structure-position computing section 36 in a case where a swing of the swing structure 2 is not sensed, and travelling of the track structure 1 is sensed, and computes the current orientation of the track structure 1 from the current orientation of the swing structure 2 computed by the swing-structure-position computing section 36 by using the stored relative relationship between the orientation of the track structure 1 and the orientation of the swing structure 2 in a case where a swing of the swing structure 2 is not sensed and travelling of the track structure 1 is not sensed, this is not the sole example, and modifications are possible within a scope not deviating from the gist of the present invention. For example, in a case where a swing of the swing structure 2 is not sensed and travelling of the track structure 1 is sensed, the track-structure-orientation computing section 37 of the controller 35D may not store the relative relationship between the orientation of the track structure 1 and the orientation of the swing structure 2 (i.e. Step S4 in FIG. 10 mentioned above may not be executed). Then, in a case where a swing of the swing structure 2 is not sensed and travelling of the track structure 1 is not sensed, the track-structure-orientation computing section 37 of the controller 35D may control the blade pilot valves 43A and 43B such that the blade 12 moves upward away from the target surface (i.e. the process may proceed to Step S12 in a case where the result of the decision at Step S2 in FIG. 10 mentioned above is NO).

In addition, in the examples explained in the third to fifth embodiments, in a similar manner to the second embodiment, the assisting device includes the inclination angle sensor 40, the blade-horizontal-coordinate computing section of the controller 35B, 35C or 35D computes the horizontal coordinates of the blade 12 on the basis of the orientation of the track structure 1 computed by the track-structure-orientation computing section 37, the horizontal coordinates and the orientation of the swing structure 2 computed by the swing-structure-position computing section 36, and the inclination angles of the track structure 1 sensed by the inclination angle sensor 40, this is not the sole example. That is, in a similar manner to the first embodiment, the assisting device may not include the inclination angle sensor 40, and the blade-horizontal-coordinate computing section of the controller 35B, 35C or 35D may compute the horizontal coordinates of the blade 12 on the basis of the orientation of the track structure 1 computed by the track-structure-orientation computing section 37 and the horizontal coordinates and the orientation of the swing structure 2 computed by the swing-structure-position computing section 36.

In addition, in the examples explained in the first to fifth embodiments, the controllers decide whether the track structure 1 is travelling by deciding whether the swing center point of the swing structure 2 is changing, this is not the sole example, and modifications are possible within a scope not deviating from the gist of the present invention. For example, forward travel sensors that sense the forward travel pilot pressures of the travel operation devices 25A and 25B may be provided, and the controllers may decide whether the track structure is travelling (specifically, travelling forward) by deciding whether both the forward travel pilot pressures sensed by the forward travel sensors are equal to or higher than a preset threshold.

In addition, although, in the examples explained in the first to fifth embodiments, the swing sensors 33A and 33B are pressure sensors that sense swing pilot pressures of the work operation device 26A, and the controllers decide whether the swing structure 2 is swinging on the basis of the swing pilot pressures sensed by the swing sensors 33A and 33B, this is not the sole example, and modifications are possible within a scope not deviating from the gist of the present invention. For example, the swing sensors may be displacement sensors that sense forward and backward displacements of the operation lever of the work operation device 26A, and the controllers may decide whether the swing structure 2 is swinging on the basis of the forward and backward displacements of the operation lever sensed by the swing sensors.

In addition, although, in the examples explained in the first to fifth embodiments, the lift sensor 34 is a displacement sensor that senses the stroke of the lift cylinder 13, and the controllers compute the relative height of the blade 12 on the basis of the stroke of the lift cylinder 13 sensed by the lift sensor 34, this is not the sole example, and modifications are possible within a scope not deviating from the gist of the present invention. For example, the lift sensor may be an angle sensor that senses the angle of the lift arm 11, and the controllers may compute the relative height of the blade 12 on the basis of the angle of the lift arm 11 sensed by the lift sensor.

In addition, although in the examples explained in the first to fifth embodiments, the controller having the swing-structure-position computing section, the track-structure-orientation computing section, the blade-horizontal-coordinate computing section, and the blade-height computing section is included, this is not the sole example, and modifications are possible within a scope not deviating from the gist of the present invention. A plurality of controllers each having a different one of the swing-structure-position computing section, the track-structure-orientation computing section, the blade-horizontal-coordinate computing section, and the blade-height computing section may be provided may be included.

Note that the hydraulic excavator is explained thus far as an example application subject of the present invention, this is not the sole example. That is, application subjects may be any work machines having a blade provided to a track structure and a swing structure provided swingably on the upper side of the track structure.

DESCRIPTION OF REFERENCE CHARACTERS

1: Track structure
2: Swing structure
3: Work device
12: Blade
13: Lift cylinder
30: Monitor
31A, 31B: Antenna
32A, 32B: Receiver
33A, 33B: Swing sensor
34: Lift sensor
35, 35A, 35B, 35C, 35D: Controller
36: Swing-structure-position computing section
37: Track-structure-orientation computing section
38, 38A: Blade-horizontal-coordinate computing section
39, 39A: blade-height computing section
40: Inclination angle sensor
42: Swing limiting valve
43A, 43B: Blade pilot valve

The invention claimed is:

1. A work machine comprising:
a travelable track structure;
a swing structure provided swingably on an upper side of the track structure;
a work device coupled to a front side of the swing structure;
a blade provided on a front side of the track structure such that the blade can be raised and lowered; and
a lift cylinder that raises and lowers the blade, wherein
the work machine includes
a swing-structure-position acquiring device that acquires a horizontal coordinate and an orientation of the swing structure,
a swing sensor that senses a swing of the swing structure,
a travel sensor that senses travelling of the track structure, and
a controller that computes an orientation of the track structure, and a horizontal coordinate of the blade, and
the controller
computes the orientation of the track structure by using a locus of the horizontal coordinate of the swing structure, the horizontal coordinate being acquired by the swing-structure-position acquiring device, in a case where a swing of the swing structure is not sensed, and travelling of the track structure is sensed, and
computes the horizontal coordinate of the blade on a basis of the computed orientation of the track structure, and the horizontal coordinate and the orientation of the swing structure acquired by the swing-structure-position acquiring device.

2. The work machine according to claim 1, further comprising:
a display device that displays the horizontal coordinate of the blade computed by the controller, wherein
in a case where a swing of the swing structure is sensed, the controller outputs, to the display device, a command for displaying an indication that a position of the blade is unknown.

3. The work machine according to claim 1, wherein
the controller
stores a relative relationship between the computed orientation of the track structure and the orientation of the swing structure acquired by the swing-structure-position acquiring device, in a case where a swing of the swing structure is not sensed, and travelling of the track structure is sensed, and
computes the orientation of the track structure from the orientation of the swing structure acquired by the swing-structure-position acquiring device by using the stored relative relationship between the orientation of the track structure and the orientation of the swing structure, in a case where a swing of the swing structure is not sensed, and travelling of the track structure is not sensed.

4. The work machine according to claim 1, further comprising:
an inclination angle sensor that senses an inclination angle of the track structure, wherein
the controller computes the horizontal coordinate of the blade on a basis of the computed orientation of the track structure, the horizontal coordinate and the orientation of the swing structure acquired by the swing-structure-position acquiring device, and the inclination angle of the track structure sensed by the inclination angle sensor.

5. The work machine according to claim 1, comprising:
a lift sensor that senses a state quantity related to raising and lowering of the blade, wherein
the swing-structure-position acquiring device further acquires a height of the swing structure, and
the controller computes a height of the blade on a basis of the state quantity sensed by the lift sensor, and the height of the swing structure acquired by the swing-structure-position acquiring device.

6. The work machine according to claim 5, further comprising:
an inclination angle sensor that senses an inclination angle of the track structure, wherein
the controller computes the height of the blade on a basis of the state quantity sensed by the lift sensor, the orientation and the height of the swing structure acquired by the swing-structure-position acquiring device, the inclination angle of the track structure sensed by the inclination angle sensor, and a computed orientation of the blade.

7. The work machine according to claim 5, comprising:
a display device that displays the horizontal coordinate and the height of the blade computed by the controller.

8. The work machine according to claim 5, wherein
the controller
enables execution of blade automatic control controlling operation of the lift cylinder; and
controls the operation of the lift cylinder such that the blade approaches a prestored target surface on a basis of the horizontal coordinate and the height of the blade in a case where the horizontal coordinate and the height of the blade are computed during the execution of the blade automatic control, and controls the operation of the lift cylinder such that the blade moves upward away from the target surface in a case where at least either the horizontal coordinate or the height of the blade is not computed during the execution of the blade automatic control.

9. The work machine according to claim 8, further comprising:

a mode selecting device that selects either a blade-position computation mode in which a position of the blade is computed or other mode in which the position of the blade is not computed, wherein the controller executes the blade automatic control when the blade-position computation mode is selected by the mode selecting device, and does not execute the blade automatic control when the other mode is selected by the mode selecting device.

10. The work machine according to claim 1, wherein the travel sensor senses forward travelling and backward travelling of the track structure, and when a swing of the swing structure is not sensed, and one of the forward travelling and the backward travelling of the track structure is sensed, the controller computes the orientation of the track structure by using the locus of the horizontal coordinate of the swing structure, the horizontal coordinate being acquired by the swing-structure-position acquiring device, and a result of sensing whether the track structure is travelling forward or backward.

11. The work machine according to claim 1, comprising:

a mode selecting device that selects either a blade-position computation mode in which a position of the blade is computed or other mode in which the position of the blade is not computed; and a swing limiting device that limits a swing of the swing structure, wherein the controller causes the swing limiting device to limit a swing of the swing structure when the blade-position computation mode is selected by the mode selecting device.

* * * * *